US009718201B2

(12) United States Patent
Swenson

(10) Patent No.: US 9,718,201 B2
(45) Date of Patent: Aug. 1, 2017

(54) SHAVING RAZOR PIVOT LOCK

(71) Applicant: The Gillette Company, Boston, MA (US)

(72) Inventor: Keith Andrew Swenson, Milton, MA (US)

(73) Assignee: The Gillette Company LLC, Boston, MA (US)

( * ) Notice: Subject to any disclaimer, the term of this patent is extended or adjusted under 35 U.S.C. 154(b) by 128 days.

(21) Appl. No.: 14/747,133

(22) Filed: Jun. 23, 2015

(65) Prior Publication Data

US 2016/0001455 A1 Jan. 7, 2016

(30) Foreign Application Priority Data

Jul. 2, 2014 (EP) ..... 14175434

(51) Int. Cl.
*B26B 21/52* (2006.01)
*B26B 21/14* (2006.01)
*B26B 21/22* (2006.01)

(52) U.S. Cl.
CPC ..... *B26B 21/521* (2013.01); *B26B 21/14* (2013.01); *B26B 21/225* (2013.01)

(58) Field of Classification Search
CPC ..... B26B 21/14; B26B 21/225; B26B 21/521
See application file for complete search history.

(56) References Cited

U.S. PATENT DOCUMENTS 3,938,247 A * 2/1976 Carbonell ..... B26B 21/225 30/47
4,083,104 A * 4/1978 Nissen ..... B26B 21/521 30/47
4,308,663 A * 1/1982 Ciaffone ..... B26B 21/225 30/531
4,797,998 A 1/1989 Motta
4,922,609 A 5/1990 Grange
5,153,992 A 10/1992 Brown et al.

(Continued)

OTHER PUBLICATIONS

PCT International Search Report with Written Opinion in corresponding international application PCT/US2015/038720 dated Sep. 24, 2015.

(Continued)

*Primary Examiner* — Hwei C Payer
(74) *Attorney, Agent, or Firm* — John M. Lipchitz; Kevin C. Johnson; Steven W. Miller

(57) ABSTRACT

A shaving razor with a handle having a gripping portion extending along a longitudinal axis and a head. A cartridge mounted to the handle and has a shaving surface with at least one blade having a blade edge, and an opposing surface. The cartridge has a forward and a rearward pivot position relative to the handle. A pivot locking mechanism positioned on the head of the handle having a pusher member that slides toward and away from the cartridge between an engaged position and a disengaged position. The pusher member in the engaged position directly contacts the opposing surface of the cartridge forcing the cartridge in the forward position preventing the cartridge from pivoting with respect to the handle. The pusher member in the disengaged position is spaced apart from the opposing surface of the cartridge in the forward position allowing the cartridge to pivot relative to the handle.

18 Claims, 7 Drawing Sheets

(56) References Cited

U.S. PATENT DOCUMENTS

| | | | | |
|---|---|---|---|---|
| 7,685,720 | B2 * | 3/2010 | Efthimiadis | B26B 21/225 30/527 |
| 2003/0213130 | A1 | 11/2003 | Motta | |
| 2004/0181953 | A1 * | 9/2004 | Follo | B26B 21/521 30/527 |
| 2015/0290819 | A1 * | 10/2015 | Giannopoulos | B26B 21/225 30/532 |
| 2016/0001455 | A1 * | 1/2016 | Swenson | B26B 21/225 30/57 |

OTHER PUBLICATIONS

EPO International Search Report with Written Opinion in corresponding international application EP 14175434.1 dated Jan. 20, 2015.

* cited by examiner

SHAVING RAZOR PIVOT LOCK

FIELD OF THE INVENTION

The present invention relates to wet shaving safety razors and more particularly to a wet shaving safety razor with a cartridge that pivots relative to a handle.

BACKGROUND OF THE INVENTION

In general, a cartridge or blade unit of a safety razor has at least one blade with a cutting edge which is moved across the surface of the skin being shaved by means of a handle to which the cartridge is attached. Some shaving razors are provided with a spring biased cartridge that pivots relative to the handle to follow the contours of the skin during shaving. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled. Razor cartridges usually include a guard which contacts the skin in front of the blade(s) and a cap for contacting the skin behind the blade(s) during shaving. The cap and guard may aid in establishing the so-called "shaving geometry", i.e., the parameters which determine the blade orientation and position relative to the skin during shaving, which in turn have a strong influence on the shaving performance and efficacy of the razor. The cap may comprise a water leachable shaving aid to reduce drag and improve comfort. The guard may be generally rigid, for example formed integrally with a frame or platform structure which provides a support for the blades. Guards may also comprise softer elastomeric materials to improve skin stretching.

Wet shaving razors have evolved over the years to include a multiplicity of blades with the goal of increasing the closeness of a shave that is achieved while also providing a comfortable shaving experience. Increasing the number of blades on a shaving razor generally tends to increase the shaving efficiency of the razor and provide better distribution of compressive forces on the skin but can reduce the ability to trim, e.g., sideburns or near the nose. In order to improve the ability to trim an extra blade mounted on the rear of the razor cartridge has been provided to improve the ability to trim. Despite many marketing efforts, the typical consumer does not realize that an extra blade is even provided for trimming. Razor cartridges having a pivot locking mechanism have also been provided to trim mustache or sideburns or to shave around the nose. However, these devices have also not been obvious or intuitive to use for the consumer. Furthermore, these mechanisms are limited because they lock the cartridge pivot by locking the cartridge biasing member and/or they take the user's hand out of it's natural position in order to lock the pivot for trimming.

Thus, there is a need for a safety shaving razor having a pivot locking mechanism that is obvious and intuitive for a consumer to notice and utilize. What is also needed is a pivot locking mechanism for a shaving razor that functions independently of a cartridge biasing member.

SUMMARY OF THE INVENTION

In one aspect, the invention features, in general a shaving razor with a handle having a gripping portion extending along a longitudinal axis and a head. A cartridge is mounted to the handle and has a shaving surface with at least one blade having a blade edge, and an opposing surface. The cartridge has a forward and a rearward pivot position relative to the handle. A pivot locking mechanism positioned on the head of the handle having a pusher member that slides toward and away from the cartridge between an engaged position and a disengaged position. The pusher member in the engaged position directly contacts the opposing surface of the cartridge forcing the cartridge in the forward position preventing the cartridge from pivoting with respect to the handle. The pusher member in the disengaged position is spaced apart from the opposing surface of the cartridge in the forward position allowing the cartridge to pivot relative to the handle.

In another aspect, the invention features, in general a shaving razor with a handle having a proximal end, a gripping portion extending along a longitudinal axis and a head toward the proximal end. A pivot locking mechanism positioned on the head of the handle having a pusher member that slides toward and away from the proximal end between an engaged position and a disengaged position. The pivot locking mechanism includes a latch that locks the pusher member in the engaged position. The shaving razor may optionally include the latch pivoting relative to the pusher member. The shaving razor may also optionally include the pivot locking mechanism having a base member joined to the head and the pusher member slidingly engages the base. The shaving razor may optionally include a biasing member and a lower portion of the latch positioned within a slot of the base that biases the pusher member toward the disengaged position. The shaving razor may also optionally include wherein the latch has an upper portion extending from a body of the latch that facilitates the latch pivoting to release the latch from the base member allowing the pusher member to slide to the disengaged position.

BRIEF DESCRIPTION OF THE DRAWINGS

Other features and advantages of the present invention, as well as the invention itself, can be more fully understood from the following description of the various embodiments, when read together with the accompanying drawings, in which.

DETAILED DESCRIPTION OF THE INVENTION

Figure 1A:
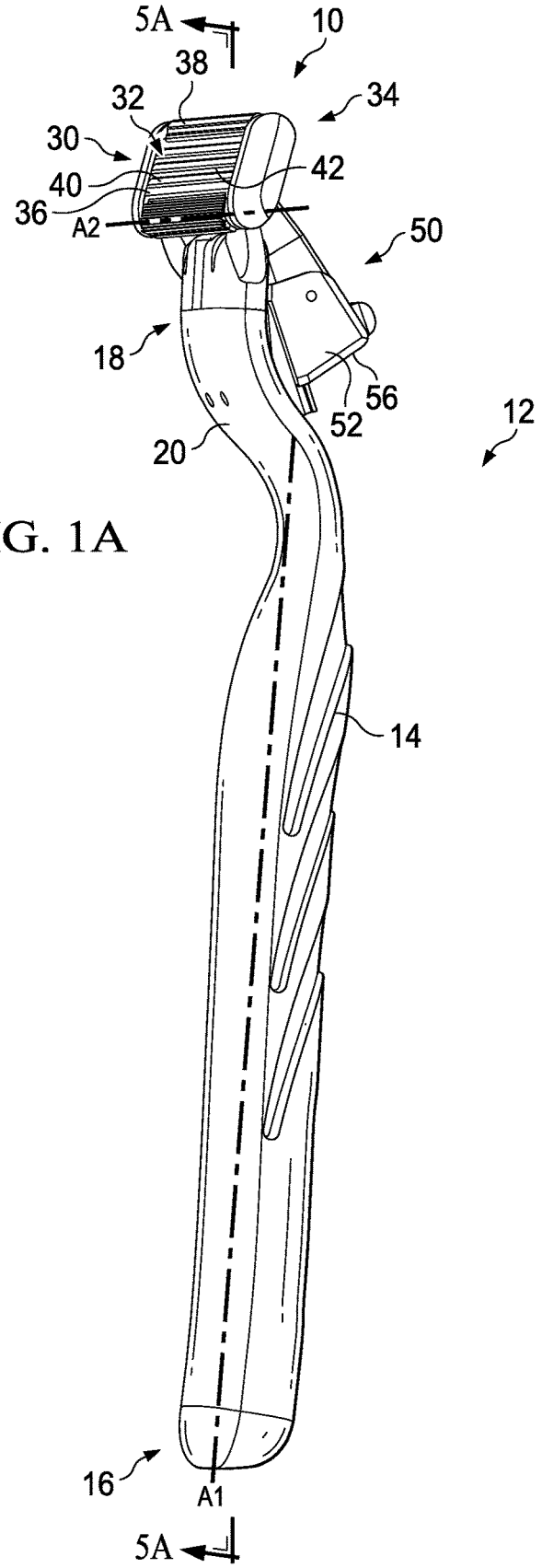
FIG. 1A is a perspective view of a shaving razor in a forward pivot position according to one possible embodiment of the present invention.
Figure 1B:
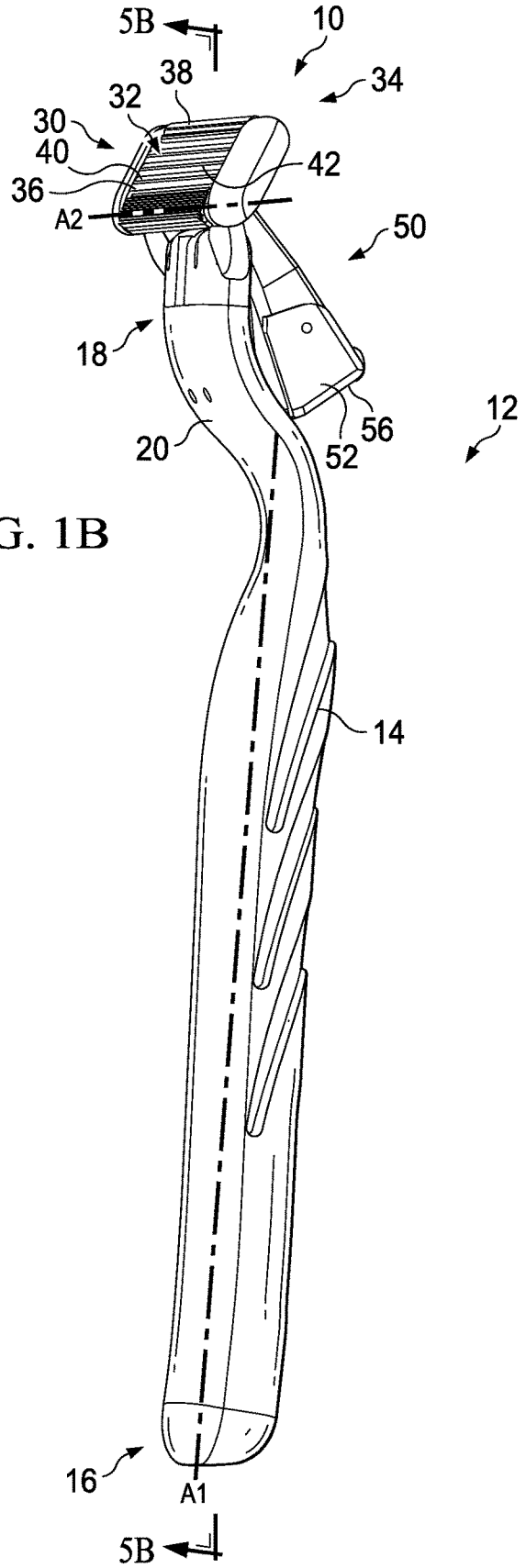
FIG. 1B is a perspective view of the shaving razor of FIG. 1A in a rearward position according to one possible embodiment of the present invention.

Referring to FIGS. 1A and 1B, perspective views of a shaving razor 10 are shown having a pivot locking mechanism 50. The shaving razor 10 may include a handle 12 having an elongated gripping portion 14 extending along a longitudinal axis A1. The handle 12 may have a head 20 positioned between a distal end 16 and a proximal end 18 of the handle 12. For example, the head 20 may be positioned toward the proximal end 18 of the handle 12. As will be described in greater detail below, the proximal end portion 18 may include a cartridge biasing member 22 (shown in FIGS. 5A-5B), such as a spring biased plunger. However, it is understood other mechanisms may also be used, such as flexible plastic and metal spring fingers. A cartridge 30 may be removable or permanently mounted to the handle 12. For example, the cartridge 30 may be mounted detachably on the handle 12 to enable the cartridge to be replaced by a fresh cartridge when the blade sharpness has diminished to an unsatisfactory level, or it may be attached permanently to the handle 12 with the intention that the entire razor be discarded when the blade or blades have become dulled. The cartridge 30 may have a shaving surface 32 and an opposing surface 34 (e.g., a non shaving surface). The shaving surface 32 may include a guard 36, a cap 38 and at least one blade 40 having a blade edge 42 between the guard 36 and the cap 38. Although three blades are shown, it is understood more or less blades may be used depending on the desired cost and performance of the shaving razor 10.

The cartridge 30 may pivot about a pivot axis A2 that is generally transverse to axis A1 and parallel to the blade edge 42 and/or the longitudinal axis of the cartridge 30. The cartridge 30 may have a forward pivot position, as shown in FIG. 1A and a rearward pivot position, as shown in FIG. 1B. The pivot motion of the cartridge 30 between the forward and rearward pivot positions may help the blade edge 42 better follow the contours of the surface of the skin during a shaving stroke, especially longer shaving strokes. The cartridge biasing member 22 may urge the cartridge 30 toward the forward pivot position. For example, when no force is exerted on the cartridge 30, the cartridge 30 may be biased in the forward pivot position.

For shorter shaving strokes, such as strokes used for trimming around the nose and side bums, it may be desirable to lock the cartridge 30 in the forward pivot position. Accordingly, a pivot locking mechanism 50 may be positioned on the head 20 of the handle 12. As will be described in greater detail below, the pivot locking mechanism 50 may include a pusher member 52 with an engaged position and a disengaged position. The pusher member 52 may slide forward (e.g., toward the cartridge 30) and rearward (e.g., toward the distal end of the handle). The pusher member 52 may have a distal end surface 56 that is generally transverse to the head 20 of the handle 12 and/or the longitude axis A1 for receiving forces exerted by a user's thumb or finger. In certain embodiments, the distal end surface 56 may be substantially flat so a user can easily actuate the pusher member 52 forward. The pusher member 52 in the disengaged positioned may be spaced apart from the opposing surface 34 of the cartridge 30 in the forward position. Accordingly, the cartridge 30 can freely pivot about pivot axis A2 (e.g., about 5 degrees to about 40 degrees) in the disengaged position. The pivot motion of the cartridge 30 may be limited in the disengaged position by a stop surface on the handle 12 or by the pusher member 52 as the cartridge pivots to the rearward position. For example, in certain embodiments, the pusher member 52 in the disengaged position, may contact the opposing surface 34 of the cartridge 30 in the rearward position, but not the forward position. Optionally, the handle 12 may provide a surface that contacts the opposing surface 34 of the cartridge 30 to limit pivoting in the rearward position when the pusher member 52 is disengaged.

The pusher member 52 may also have an intermediate position between the engaged and disengaged positions. For example, in the intermediate position the pusher member 52 may be spaced apart from the opposing surface 34 of the cartridge 30 in the forward pivot position and contact the opposing surface of the cartridge 30 in the rearward pivot position. Accordingly, a user may be able to manually adjust or further limit the range the cartridge is able to pivot about the pivot axis A2 (e.g., from 5 to 40 degrees to 5 to 15 degrees).

Figure 2:
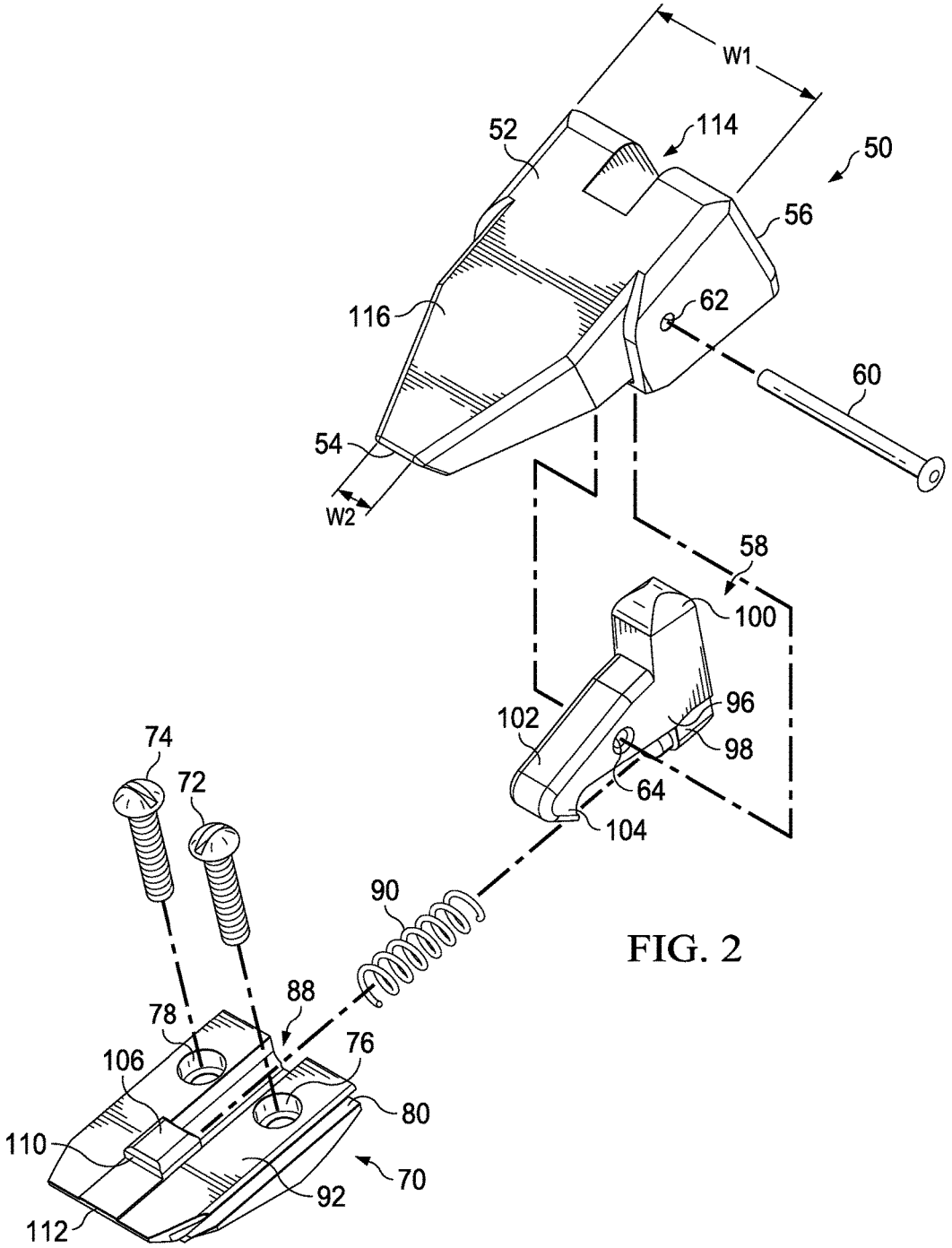
FIG. 2 is an assembly view of a locking mechanism that may be incorporated into the shaving razor of FIG. 1A.

Referring to FIG. 2, an assembly view of the pivot locking mechanism 50 is shown. The locking mechanism 50 may include the pusher member 52, a latch 58 and a base member 70. The distal end surface 56 of the pusher member 52 may have a width "W1" measured in a direction transverse to the axis A1 and/or parallel to the axis A2 that is greater than a width "W2" of the proximal end surface 54 of the pusher member 52. The proximal end surface 54 may be the portion of the pusher member that contacts the opposing surface in the engaged position. Accordingly, the width of the distal end surface 56 may be maximized for easy actuation by a user and the width of the proximal end surface 54 may be minimized to reduce interference with the cartridge 30. For example, a large proximal end surface 54 may negatively impact rinsing of the cartridge 30. The user may push the distal end surface 56 to slide the pusher member 52 forward into the engaged position. As will be described in greater detail below, the pusher member 52 may be locked in the engaged position automatically or the user may simply hold the pusher member 50 in the engaged position for the desired amount of time needed to lock the pivot of the cartridge 30 for trimming The forward-rearward sliding motion of the pusher member 52 and the pusher member 52 being positioned on the head 20 of the handle 12 facilitates locking of the pivot motion of the cartridge 30 without the need of the consumer to move their fingers or hands from their normal shaving position, thus providing for improved ergonomics between shaving and trimming strokes. In addition, the pivot locking mechanism 50 may also be operated with a single hand or finger. As will be described in greater detail below, the pusher member 50 may be locked and released with the operation of a single finger or thumb.

Figure 3:
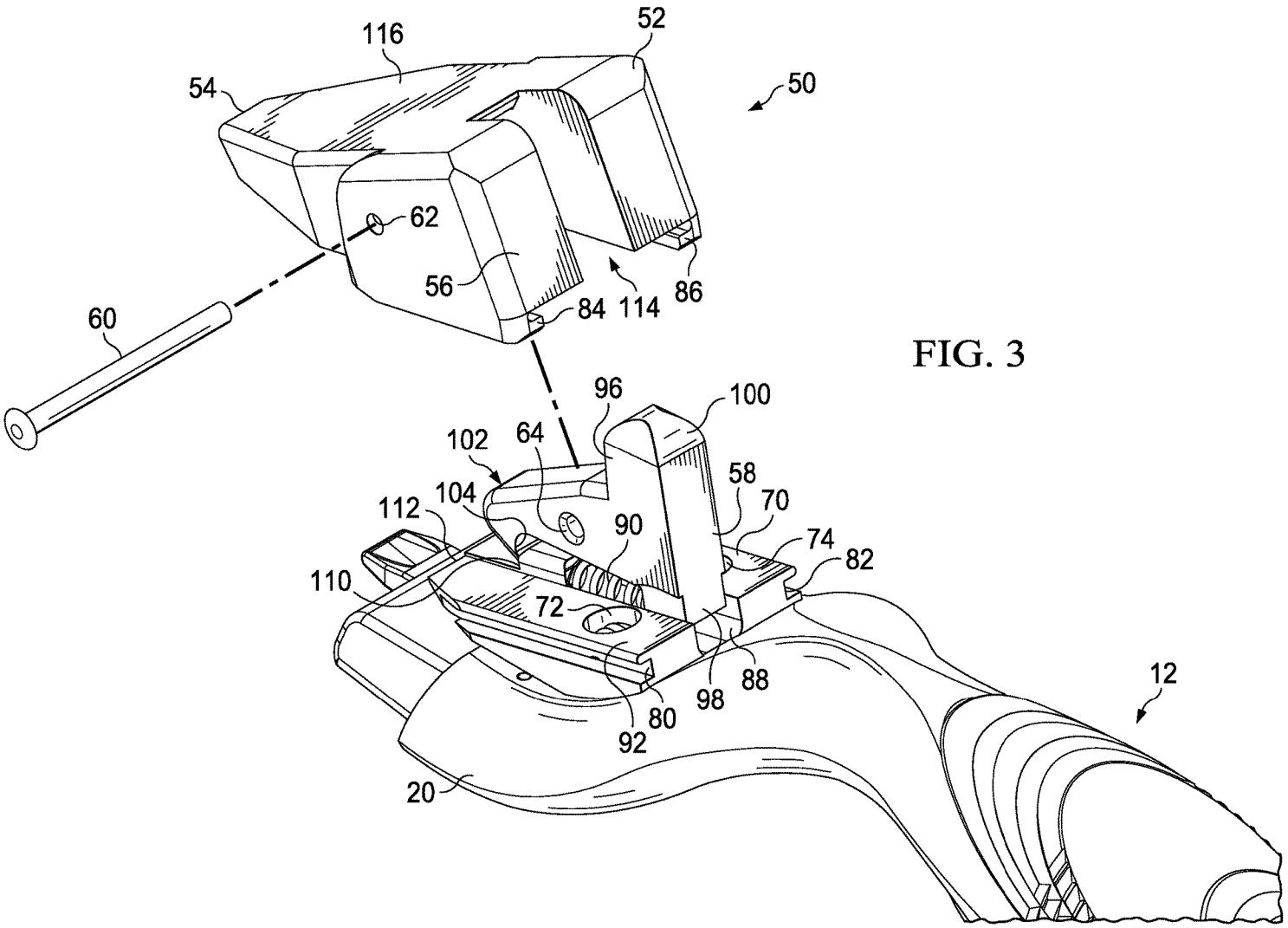
FIG. 3 is an assembly view of the shaving razor of FIGS. 1A and 1B.
Figure 4:
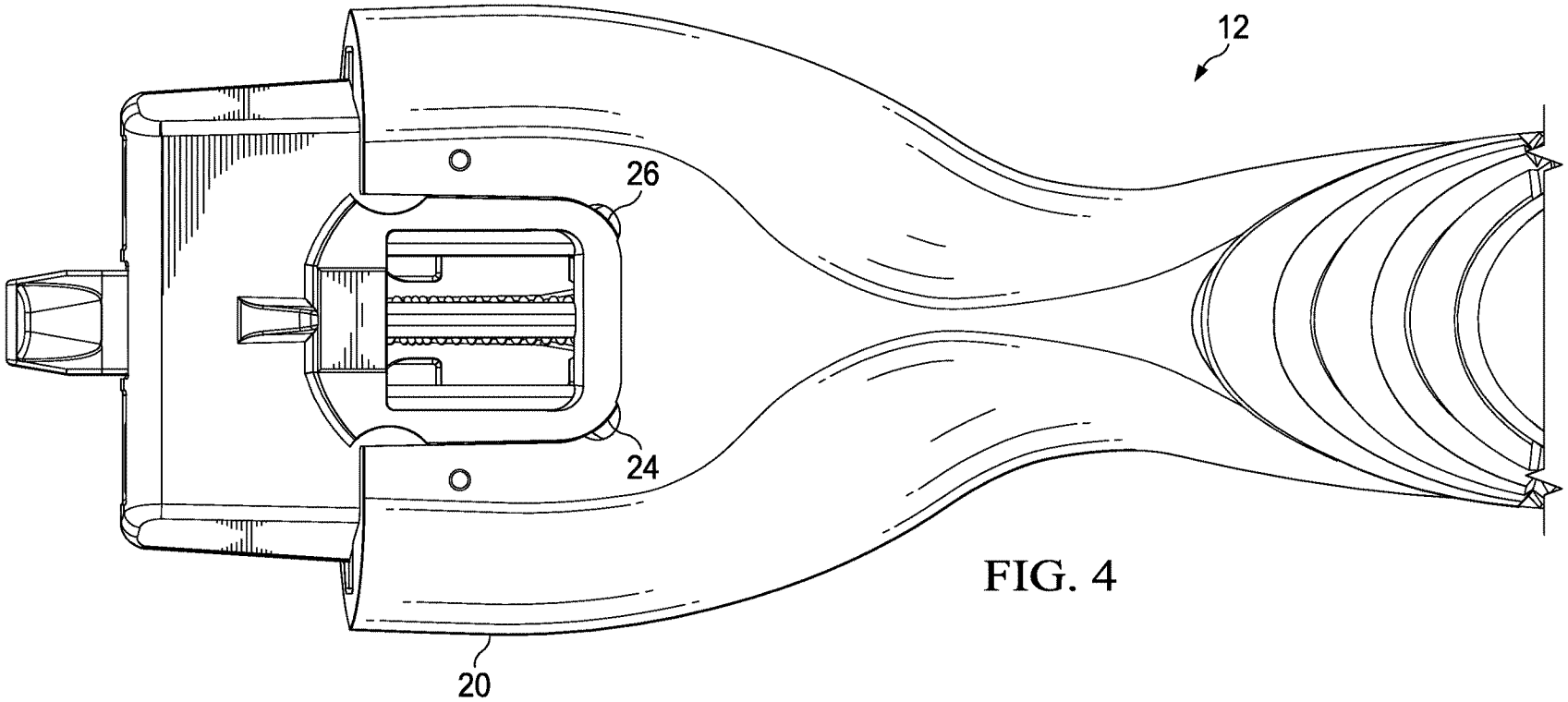
FIG. 4 is a top view of a handle that may be incorporated into the shaving razor of FIG. 1A.

The base member 70 may define a slot 88 for receiving a biasing member 90 and a portion of the latch 58. The slot 88 may be positioned on a top surface 92 the base member 70. The base member 70 may have a protrusion 106 (e.g., on the top surface 92) having a first stop surface 110 (e.g., front face of protrusion 106) for engaging a portion of the latch 58. The base member 70 may also have a second stop surface 112 for engaging a portion of the latch. The top surface 92 may define pair of apertures 76 and 78 extending through the base member 70. Each of the apertures 76 and 78 may receive a respective fastener 72 and 74. FIG. 3 illustrates the base member 70 secured to the handle 12. The base member 70 may be rigidly secured to the head 20 of the handle 12. For example, the pair of fasteners 72 and 74, such as screws or pins, may be inserted into the corresponding openings 76 and 78 defined by the base member. The fasteners 72 and 74 may engage the head 20 to secure the base member 70 to the handle 12. For example, the handle 12 may have corresponding openings 24 and 26 (as shown in FIG. 4) in the head 20 that receive the fasteners 72 and 74. Although the base member 70 is illustrated as being assembled to the handle 12, it is also possible to manufacture the base member 70 as part of the handle 12. The position of the locking mechanism 50 on the head 20 of the handle 12 (e.g., top surface of the handle 12 opposite the shaving surface 32 of the cartridge 30) allows the locking mechanism to be easily attached to an existing user's handle or easily incorporated into an existing handles with minimal redesign of the handle.

Referring to FIGS. 2 and 3, the latch 58 may slidingly engage the base member 70. For example, the latch 58 may have a body 96 with a lower portion 98 that is slidingly engaged within the slot 88 of the base member 70. The lower portion 98 may facilitate the latch 58 and the pusher member 52 sliding between forward and rearward positions. The slot 88 may also receive the biasing member 90, such as a spring. The lower portion 98 may also engage the biasing member 90 located within the slot 88. Accordingly, the biasing member 90 may force the latch 58 in a rearward position in a direction away from the cartridge 30.

As best shown in FIG. 3, the base member 70 may have one or more sliding surfaces 80 and 82 that engage a corresponding pair of sliding surfaces 84 and 86 of the pusher member 52. The sliding surfaces 80 and 82 of the base member 70 may engage the corresponding sliding surfaces 84 and 86 on the pusher member 52 such that the pusher member 52 is positioned over the latch 58. The sliding surfaces 80 and 82 of the base member 70 may be a pair of opposing grooves and the corresponding sliding surfaces 84 and 86 on the pusher member 52 may be a pair of rails. Accordingly, the sliding surfaces 80 and 82 of the base member 70 and the corresponding sliding surfaces 84 and 86 on the pusher member 52 may secure the base member 70 to the pusher member 52 and limit movement of the pusher member 52 (and the latch 58) relative to the base member 70 to a forward-rearward sliding motion. A pin 60 may pass through an opening 62 in the pusher member 52 and an opening 64 in the latch 58 to pivotally couple the latch 58 to the pusher member 52. Accordingly, the latch 58 may pivot relative to the pusher member 52 and/or the base member 70, but the latch 58 and the pusher member 52 may also slide in a forward-rearward direction together as a single unit. As will be described in greater detail below, the sliding of the pivot member 52 and the latch 58 may facilitate the pusher member 52 engaging and locking the pivoting of the cartridge 30. The pivoting of the latch 58 may facilitate the release of the latch 58 from the base member 70.

The body 96 of the latch 58 may have an upper portion 100 extending from the body 96 in an opposite direction from the lower portion 98. The upper portion 100 may be positioned within a slot 114 located on the distal end surface 56 of the pusher member 52. The upper portion 100 may also extend above a top surface 116 of the pusher member 52 to allow a user to easily actuate the latch 58 (e.g., pivot the latch 58 relative to the base member 70). In certain embodiments, a proximal end portion 102 of the body 96 may have an undercut 104 (e.g., a hook) that engages one or more corresponding surfaces on the base member 70. For example, the corresponding surfaces may include a first stop surface 110 (e.g., front face of the protrusion 106) and/or the second stop surface 112 (e.g., ledge of the base member 70).

Figure 5A:
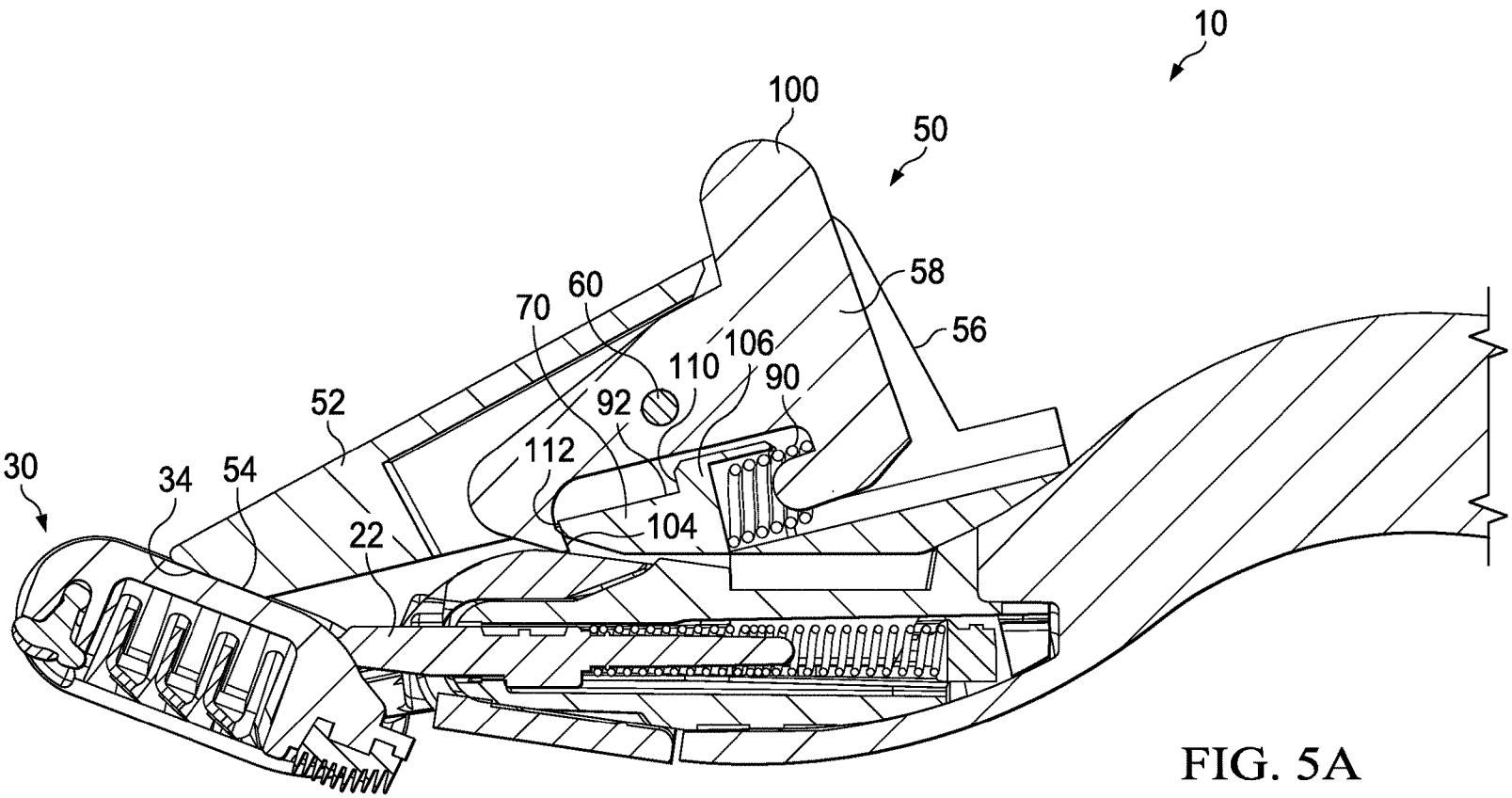
FIG. 5A is a cross section view of the shaving razor of FIG. 1A in an engaged position, taken generally along the line 5A-5A.
Figure 5B:
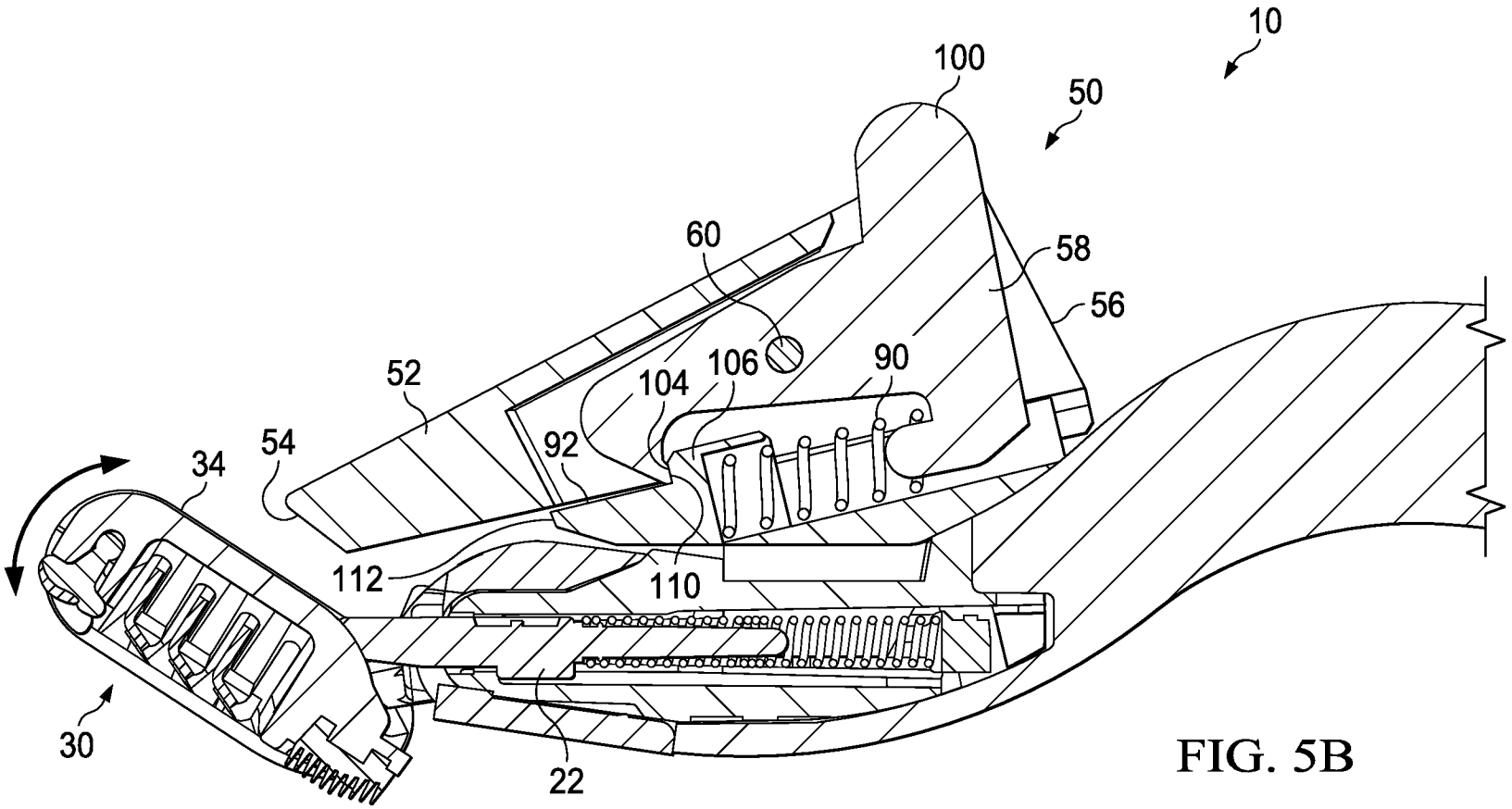
FIG. 5B is a cross section view of the shaving razor of FIG. 1B a disengaged position, taken generally along the line 5B-5B.

Referring to FIGS. 5A and 5B, the shaving razor 10 with the attached locking mechanism 50 is shown with the cartridge 30 in a forward position. The cartridge biasing member 22 may push against the cartridge 30 (e.g., opposing surface 34) to urge the cartridge 30 toward the forward pivot position. For example, when no force is exerted on the cartridge 30, the cartridge 30 may be biased in the forward pivot position. However, during shaving strokes, force of the biasing member may be overcome and the cartridge 30 may pivot freely between the forward and the rearward positions (as shown in FIG. 5B). The pivot motion of the cartridge 30 between the forward and rearward pivot positions may help the blade edge 42 better follow the contours of the surface of the skin during a shaving stroke, especially longer shaving strokes. If a consumer desires to use the shaving razor 10 for trimming, he may urge the pusher member 52 forward by pressing against the distal end surface 56 so the proximal end 54 of the pusher member 52 contacts the opposing surface 34 of the cartridge 30 to keep the cartridge 30 in the forward position (i.e., the engaged position), as shown in FIG. 5A. As the pusher member 52 slides forward, the undercut 104 may slide against the top surface 92 of the base member 70. The pin 60 may facilitate the latch 58 to pivot (relative to the pusher member 52 and the base member 70) to engage the second stop surface 112 locking the pusher member 52 and the latch 58 in the engaged position. Accordingly, the cartridge 30 is prevented from pivoting or rocking in a rearward direction to allow for more controlled and precise trimming stokes.

After trimming, a user may want the cartridge 30 to pivot so the shaving razor 10 can be used for shaving strokes. Accordingly, the user may actuate or move the upper portion 100 of the latch 58 in a rearward direction (e.g., away from the cartridge 30) causing the latch 58 to pivot relative to the base member 70. The upper portion 100 may facilitate the latch 58 pivoting to release the undercut 104 from the second stop surface 112. Once released, the latch 58 and the pusher member 52 may slide to the disengaged position. The undercut 104 may engage the first stop surface 110 on the protrusion 106 (as shown in FIG. 5B). The first stop surface 110 and the second stop 112 may be transverse to the top surface 92 for improved engagement with the undercut 104 of the latch 58. As shown in FIG. 5B, the pusher member 52 in the disengaged position is spaced apart from the opposing surface 34 of the cartridge 30 in the forward position allowing the cartridge to pivot relative to the handle. When the cartridge 30 moves to the rearward pivot position, the opposing surface 34 may contact the pusher member 52 to limit the range of pivoting of the cartridge 30. Alternatively, a separate stop surface may be provided to limit pivoting the cartridge 30 when the pusher member 52 is disengaged.

The biasing member 90 may urge the latch 58 in the rearward direction (e.g., away from the cartridge 30). Accordingly, under normal shaving conditions, the latch member remains disengaged from the second stop surface 112 of the base member 70 to allow the cartridge 30 to pivot. In addition, the user only needs a single motion (i.e., pivoting the latch 58) and does not need to force the latch 58 in the rearward direction because the biasing member 90 urges the latch in the rearward direction automatically once the undercut 104 is released from the second stop surface 112. Accordingly, the pusher member 52 may be released with a simple motion of a single finger or thumb without requiring the consumer to change their hand grip of the razor. In certain embodiments, the upper portion 100 may be a different color (e.g., a contrasting color) than the pusher member 52. Accordingly, actuating the upper portion 100 to release the latch 58 is more intuitive to a user.

The locking mechanism 50 (e.g., the pusher member 52) is spaced apart from the cartridge biasing member 22. Accordingly, the locking mechanism 50 can be easily added to any kind of razor handle without impacting the pivoting force provided by the cartridge biasing member 22. For example, the locking mechanism 50 may even be provided as an after market product for consumers to attach to their existing handle.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving razor comprising:

a handle having a gripping portion extending along a longitudinal axis and a head;

a cartridge mounted to the handle, the cartridge having a shaving surface with at least one blade having a blade edge, and an opposing surface, the cartridge having a forward pivot position and a rearward pivot position relative to the handle;

a pivot locking mechanism positioned on the head of the handle, the pivot locking mechanism having a pusher member that slides toward and away from the cartridge between an engaged position and a disengaged position wherein the pusher member in the engaged position directly contacts the opposing surface of the cartridge forcing the cartridge in the forward pivot position preventing the cartridge from pivoting with respect to the handle, and the pusher member in the disengaged position is spaced apart from the opposing surface of the cartridge in the forward pivot position allowing the cartridge to pivot relative to the handle, wherein the pivot locking mechanism comprises a latch that locks the pusher member in the engaged position and the latch has an upper portion extending from a body of the latch that facilitates the latch pivoting to release the latch allowing the pusher member to slide to the disengaged position.

2. The shaving razor of claim 1 wherein the pusher member is biased in the disengaged position.

3. The shaving razor according to claim 1 wherein the pusher member in the disengaged position is spaced apart from the opposing surface of the cartridge in the rearward pivot position.

4. The shaving razor of claim 1 wherein the latch pivots relative to the pusher member.

5. The shaving razor of claim 1 wherein the pivot locking mechanism comprises a base member joined to the head, and the pusher member slidingly engages the base member.

6. The shaving razor of claim 5 wherein the base member has at least one sliding surface that engages a corresponding surface on the pusher member.

7. The shaving razor according to claim 5 wherein a biasing member and a lower portion of the latch are positioned within a slot of the base member.

8. The shaving razor according to claim 5 wherein the latch has an undercut that engages a first stop surface on the base member in the disengaged position and a second stop surface on the base member in the engaged position.

9. The shaving razor according to claim 1 wherein the pusher member has a distal end surface that is generally transverse to the head of the handle for receiving forces exerted by a user's thumb or finger.

10. The shaving razor according to claim 1 further comprising a cartridge biasing member spaced apart from the pusher member and contacts the opposing surface of the cartridge biasing the cartridge in the forward position.

11. A shaving razor comprising:

a handle having a gripping portion extending along a longitudinal axis and a head;

a cartridge mounted to the handle, the cartridge having a shaving surface with at least one blade having a blade edge, and an opposing surface, the cartridge having a forward pivot position and a rearward pivot position relative to the handle;

a pivot locking mechanism positioned on the head of the handle, the pivot locking mechanism having a pusher member that slides toward and away from the cartridge between an engaged position and a disengaged position wherein the pusher member in the engaged position directly contacts the opposing surface of the cartridge forcing the cartridge in the forward pivot position preventing the cartridge from pivoting with respect to the handle, and the pusher member in the disengaged position is spaced apart from the opposing surface of the cartridge in the forward pivot position allowing the cartridge to pivot relative to the handle, wherein the pusher member has a distal end surface that is generally transverse to the head of the handle for receiving forces exerted by a user's thumb or finger and the distal end surface has a width that is greater than a proximal end surface of the pusher member and in the engaged position the proximal end surface contacts the opposing surface of the cartridge in the forward pivot position.

12. The shaving razor according to claim 11 wherein the cartridge pivots about an axis generally transverse to the longitudinal axis of the gripping portion and generally parallel to the blade edge.

13. The shaving razor of claim 11 wherein the pivot locking mechanism comprises a latch that locks the pusher member in the engaged position, and the latch pivots relative to the pusher member.

14. The shaving razor of claim 13 wherein the pivot locking mechanism comprises a base member joined to the head, and the pusher member slidingly engages the base member.

15. The shaving razor of claim 14 wherein the base member has at least one sliding surface that engages a corresponding surface on the pusher member.

16. The shaving razor according to claim 14 wherein a biasing member and a lower portion of the latch are positioned within a slot of the base member.

17. The shaving razor according to claim 14 wherein the latch has an undercut that engages a first stop surface on the base member in the disengaged position and a second stop surface on the base member in the engaged position.

18. The shaving razor according to claim 14 further comprising a cartridge biasing member spaced apart from the pusher member and contacts the opposing surface of the cartridge biasing the cartridge in the forward pivot position.

* * * * *